United States Patent [19]

Máhig et al.

[11] 4,087,209

[45] May 2, 1978

[54] DISPLACEMENT SLURRY PUMP

[75] Inventors: Lászlo Máhig; Mihály Márton; János Steiner, all of Budapest, Hungary

[73] Assignee: Aluterv Aluminiumipari Tervezo Vallalat, Budapest, Hungary

[21] Appl. No.: 637,849

[22] Filed: Dec. 5, 1975

[51] Int. Cl.[2] ..... F04B 3/00; F04B 39/00

[52] U.S. Cl. ..... 417/268; 417/521; 417/539

[58] Field of Search ..... 92/86.5; 417/254, 267, 417/268, 521, 539

[56] References Cited

U.S. PATENT DOCUMENTS

| | | | |
|---|---|---|---|
| 1,322,236 | 11/1919 | Fish | 417/503 |
| 1,550,767 | 8/1925 | Weaver | 417/900 |
| 1,964,932 | 7/1934 | Stoesling et al. | 92/86.5 |
| 2,330,781 | 9/1943 | Langmyhr et al. | 92/86.5 |
| 2,365,234 | 12/1944 | Winnemann | 417/250 |
| 3,075,473 | 1/1963 | Finley | 417/505 |
| 3,091,186 | 5/1963 | Hofmeister | 417/250 |
| 3,104,619 | 9/1963 | Swarthout | 92/86.5 |
| 3,229,900 | 1/1966 | McCrory et al. | 92/86.5 |
| 3,749,529 | 7/1973 | Cornelson | 92/86.5 |
| 3,832,935 | 9/1974 | Syassen | 92/86.5 |

*Primary Examiner*—William L. Freeh

[57] ABSTRACT

Displacement slurry pump equipped with known piston-rod drive, in which on a piston rod expediently three pistons are arranged at a distance of at least one stroke length, they are a liquid piston moving the auxiliary liquid free of solid matter, and on both sides thereof a slurry piston each moving on one side the slurry, on the other side, however, the auxiliary liquid. The liquid piston fits sealed to the liquid cylinder provided with liquid suction valves, whereas the two slurry pistons fit by slot to the slurry cylinders provided with slurry suction valves and slurry delivery valves. The effective section of the liquid cylinder is larger than the effective section of a slurry cylinder each. The slurry pump may be of single-operation or of double-operation, of one-cylinder or two-cylinder or three-cylinder construction.

During the operation, at the delivery stroke of the slurry cylinder, auxiliary liquid is pressed from the liquid cylinder through the aperture between the slurry cylinder and slurry piston, preventing thus the slurry from flowing in between the slurry piston and the slurry cylinder, thus the life of these latters will increase.

4 Claims, 3 Drawing Figures

DISPLACEMENT SLURRY PUMP

Application field: alumina production, mining industry, mineral oil industry, thermal power stations.

The delivery in medium- and high-pressure range of slurries of high solid content and of erodent property causes a considerable problem all over the world, especially in the chemical industry, alumina production and mining industry. The pump elements rubbing each other during the operation and contacting also the slurry are subject of considerable wear, thus their life is short. The aim of the present invention is the development of a slurry pump in which the frictional pump elements cannot contact the slurry, their life being thus increased.

With the known displacement slurry pumps the slurry contacts directly the piston, the inner surface of the cylinder, the piston rod and the packing material of the packing gland of the piston rod. All these parts shall be replaced after a shorter or longer while, being an expensive and laboursome operation, moreover, in case of continuous operation an emergency pump shall be kept on store.

This drawback is eliminated by the well known diaphragm pumps used for the delivery of high-pressure slurries, which, however, are extremely expensive and also the life of the diaphragm is limited.

Recently the pressure-vessel slurry pumps (hydro hoist) appeared, the operation of which is briefly as follows: the low-pressure pump presses the slurry into e.g. the lower part of the first unit of three parallelly connected pressure vessels. The slurry level having reached a specified value, the low-pressure slurry pressure duct automatically changes over to the following unit, while the high-pressure auxiliary liquid pump begins to press auxiliary liquid into the upper part of the first unit; this auxiliary liquid then presses out at a high pressure the slurry from the lower part of the unit. When the second pressure vessel is also filled with low-pressure slurry, the high-pressure auxiliary liquid is connected thereto, while the low-pressure slurry pressure duct is connected to the third pressure vessel. This process is cyclically repeated so that in this way the delivery at high pressure of the slurry is continuously ensured. For the practical application of this principe there are several partial solutions. The slurry in the pressure vessel is e.g. separated by a disc operating like a piston, from the auxiliary liquid located above it, but there is such a solution too, where the two liquids are in direct contact; in this case, however, the auxiliary liquid is generally oil. This can be, however, used only in case of a technology where the entering into the slurry of a part of the oil does not cause any trouble. The pressure-vessel slurry pumps are provided with highly intricate automatic equipment for ensuring the alternating opening and closing of the valves.

The present invention is a further development of the displacement pump in such a way that no slurry could get into contact with the parts sliding on each other, only an auxiliary liquid free of solid can directly contact these parts and said auxiliary liquid shall be chosen in a manner that it would not have an erodent effect, on the one hand, and if a few percents thereof would enter the slurry, on the other hand, this would be there useful or neutral. Such an auxiliary liquid could be water in case of fly ash or mining sludge, whereas digesting liquor in case of slurry of alumina production.

In order to achieve the set aim the present invention is a displacement slurry pump equipped with a known piston-rod drive which has a slurry cylinder and a liquid cylinder of common shaft, directly connected to each other, the diameter of said liquid cylinder is larger than that of said slurry cylinder, in said slurry cylinder a slurry piston is fitted by aperture, in said liquid cylinder, however, a liquid piston of sealed fitting is arranged, said slurry piston and said liquid piston are arranged on a common piston rod in a distance from each other of at least one stroke length, said liquid cylinder has in its dead space towards said slurry cylinder a liquid inlet valve connected to an auxiliary liquid duct, said slurry cylinder has in its dead space being farther from said liquid cylinder a slurry suction valve connected to a slurry suction duct and slurry delivery valve connected to a slurry delivery duct. With an advantageous embodiment, on a piston rod slurry pistons are arranged on each sides of said liquid piston and the corresponding cylinder described above in detail belongs to said liquid piston as well as to said two slurry pistons. The slurry pump according to the invention can be developed in duplex, triplex or any other construction. Each embodiment can be produced in such a way that on the side towards the slurry of a packing gland of piston rod a protective cone fitted by slot to said piston rod is fastened to the cylinder bottom. The space under said protective cone is connected to the pressure chamber of said liquid cylinder by a channel or a duct and a said channel or said duct a pressure valve opening to said slurry cylinder is located, rendering possible that due to the pressure of the auxiliary liquid such auxiliary liquid enter the inside of said protective cone and that therefrom a part of the auxiliary liquid enter the slurry space through the slot between said protective cone and said piston rod, respectively.

The embodiment shown by way of example of the invention will be introduced by means of the figures.

FIG. 2 shows that of the one-cylinder double-operation embodiment, whereas

Figure 3:
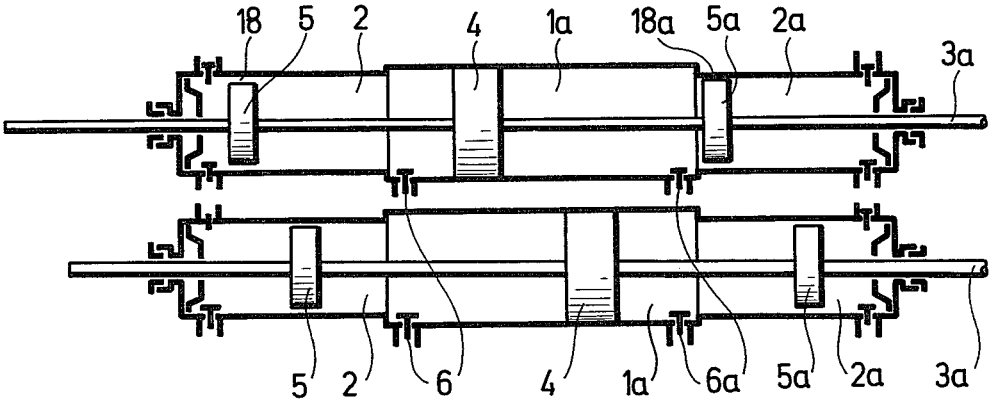

FIG. 3 that of the double-cylinder (duplex) variant.

Figure 1:
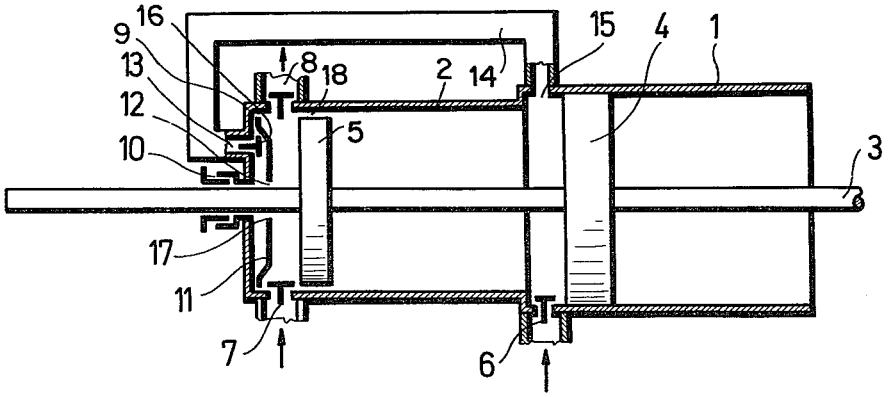
FIG. 1 shows the scheme of the one-cylinder, single-operation embodiment of the slurry pump according to the invention.

In FIG. 1 a slurry cylinder 2 of smaller cylinder bore is connected to a liquid cylinder 1. On a common piston rod 3, a lquid piston 4 and a slurry piston 5 of smaller effective section than the former one, are located at a distance larger than one stroke, between the slurry piston 5 and the inner surface of the slurry cylinder 2 a slot 18 is provided for. To the liquid cylinder 1 a liquid suction valve 6 is connected, whereas to the slurry cylinder 2 a slurry suction valve 7 and a slurry delivery valve 8 are connected. The piston rod 3 penetrates through the cylinder head 9 of the slurry cylinder 2, where a sealing is provided for by a packing gland 10. To the inside of the cylinder head 9 a protective cone 11 is solidly joined by its flange, on which an aperture 12 is made for the penetration of the piston rod 3, this aperture 12 being larger than the cross-section of the piston rod 3, consequently a slot 17 is between the piston rod 3 and the protective cone 11. On the cylinder head 9 an opening 13 is made being connected through a duct 14 to an opening 15 on the liquid cylinder 1. The duct 14 is provided with a pressure valve 16.

The operation of the described one-cylindez, single-operation slurry pump is as follows: it shall be started from the fact that the cylinder space between the liquid piston 4 and the slurry piston 5 is filled with auxiliary liquid. At the suction stroke slurry flows through the slurry suction valve 7 in the cylinder space towards the slurry suction valve 7 of the slurry cylinder 2, and at the meantime, auxiliary liquid supply enters through the liquid suction valve 6 into the cylinder space between the liquid piston 4 and the slurry piston 5. The quantity per stroke of this supply is nearly equal to the product of the difference of effective sections of liquid piston 4 and slurry piston 5 and of the stroke, supposed that the pressure of the auxiliary liquid flowing in at the liquid suction valve 6 is higher than that of the slurry flowing in at the slurry suction valve 7. At the delivery stroke, the slurry discharges through the slurry delivery valve 8, and at the same time, the auxiliary liquid quantity sucked in as feed during the suction stroke is pressed through the slot 18 on the periphery of the slurry piston 5 into the cylinder space towards the slurry inlet valve 7 of the slurry cylinder 2, on the one hand, and through the opening 15, the duct 14, the opening 13 and the pressure valve 16 into the space under the protective cone 11, on the other hand, and therefrom through the aperture 17 similarly to the cylinder space towards the slurry suction valve 7 of the slurry cylinder 2. During the delivery stroke the auxiliary liquid flowing through the aperture 18 prevents the slurry from entering in between the slurry piston 5 and the internal surface of the slurry cylinder 2, whereas the auxiliary liquid flowing through the aperture 17 prevents the slurry from entering under the protective cone 11, and to the packing gland 10, respectively. Under such conditions the slurry cylinder 2, the slurry piston 5, the piston rod 3 and the packing gland 10 are protected against the erodent effect of the slurry.

Figure 2:
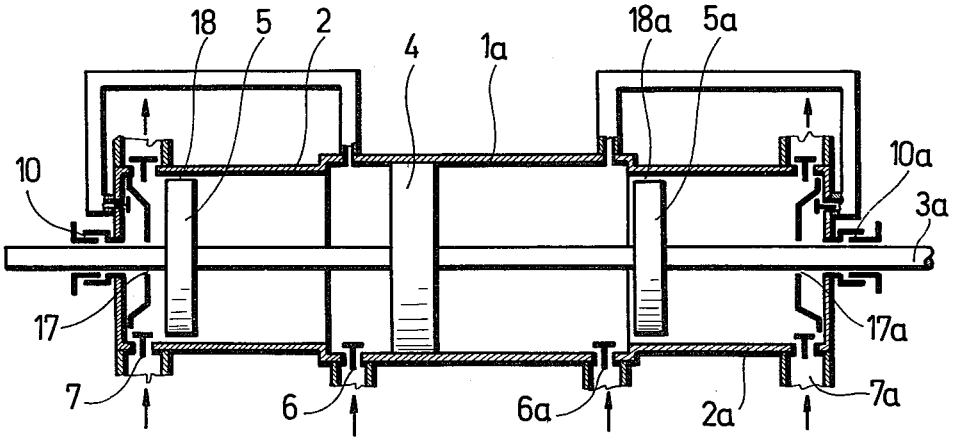

The slurry pump shown in FIG. 2 is of double operation. Its left side is identical with the slurry pump shown in FIG. 1, whereas its right side is the symmetrical equivalent thereof. On a piston rod 3*a* three pistons, namely a slurry piston 5, a liquid piston 4 and a second slurry piston 5*a* are arranged. With respect to the pistons and to the corresponding cylinders, only the liquid piston 4 is of double operation, since at each stroke it sucks the auxiliary liquid on the one side and discharges it on the other side. The slurry piston 5 sucks the slurry at the stroke directed towards the pump centre, and presses it out at the stroke in the opposite direction. The slurry piston 5*a* presses out the slurry at the stroke directed towards the pump centre, and sucks it in at the stroke in opposite direction. It is well known that the double-operation construction delivers more uniformly the slurry, than the single-operation one, showed in FIG. 1.

FIG. 3 shows a two-cylinder (duplex) double-operation variant of the slurr, pump according to the invention. In this case, under the expression "duplex" two cylinder rows arranged parallelly to each other and each comprising three cylinders, namely 1*a*, 2, 2*a* are to be understood. The crank arms of the two piston rods 3*a* are wedged at 90° to each other as usual with the duplex pumps, that is, if one piston row is e.g. in the end position, the other one is in mid-position. In FIG. 3, in order to make the Figure more clear, the duct 14 and its accessories are not shown.

The slurry pump according to FIGS. 2 and 3 operates, corresponding to the inventive idea, in such a manner that on both sides of the liquid piston 4 auxiliary liquid free of solid is to be found. The slurry flows in at the corresponding suction stroke through the slurry suction valve 7 (7*a*) into the cylinder space between the slurry piston 5 (5*a*) and the cylinder head 9 (9*a*). In the course of the operation, the auxiliary liquid flows through the apertures 18 (18*a*) and 17 (17*a*) at the delivery stroke of the slurry piston 5 (5*a*) preventing thus that the slurry could get between the slurry piston 5 (5*a*) and the cylinder 2 (2*a*) as well as in between the piston rod 3*a* and the packing gland 10 (10*a*). The apertures 17 (17*a*) and 18 (18*a*) as well as the pressure valve 16 are dimensioned so that only a minimum quantity of auxiliary liquid could get into the slurry and at the same time, no slurry could get in between the surfaces sliding on each other.

The slurry pump according to the invention can be advantageously used in the alumina production, in the mineral oil and mining industry and anywhere slurry of high volume-speed shall be delivered at a high pressure.

What we claim is:

1. A displacement slurry pump comprising a cylinder having, in coaxial arrangement, a slurry section and an auxiliary liquid section with a diameter greater than that of said slurry section, a reciprocating piston rod in said cylinder carrying a slurry piston in the slurry section with a diameter such that an aperture remains between the periphery of the piston and the wall of the slurry section, and an auxiliary liquid piston with a diameter providing a sealed fitting in the auxiliary liquid section of said cylinder, said slurry piston and said auxiliary liquid piston being separated on said piston rod by at least one stroke length, said auxiliary liquid section being provided adjacent the slurry section with valved means for introducing auxiliary liquid at a pressure greater than the slurry inlet pressure, said slurry section being closed at its end farthest from said auxiliary liquid section and provided adjacent said end with valved slurry inlet means and valved slurry outlet means, said piston rod passing through packing gland means in said closed end of said slurry section, flange means attached to the inner wall of said closed end of said slurry section, thereby forming an auxiliary liquid compartment in said slurry section, said flange means being provided with an aperture larger than the cross-section of said piston rod through which said piston rod passes relatively loosely, and external valved duct means connecting said auxiliary liquid compartment with said auxiliary liquid section at a locus adjacent the slurry section.

2. A multiple cylinder pumping system comprising a plurality of interconnected pumps as defined in claim 1.

3. A displacement slurry pump according to claim 1 wherein a second slurry section is provided in said cylinder on the other side of said auxiliary liquid section from said slurry section, said second slurry section having a diameter smaller than that of said auxiliary liquid section, and a second slurry piston is provided on said piston rod in said second slurry section, said second slurry piston having a diameter such that an aperture remains between the periphery of the piston and the wall of said second slurry section, said second slurry piston and said auxiliary liquid piston being separated on said piston rod by at least one stroke length, said auxiliary liquid section also being provided adjacent said second slurry section with valved means for introducing auxiliary liquid at a pressure greater than the slurry inlet pressure, said second slurry section being closed at its end farthest from said auxiliary liquid section and provided adjacent said end with valved slurry inlet means and valved slurry outlet means, said piston rod passing through packing gland means in the closed end of said second slurry section, flange means attached to the inner walls of the closed end of said second slurry section, thereby forming an auxiliary liquid compartment in said second slurry section, said flange means being provided with an aperture larger than the cross-section of said piston rod through which said piston rod passes relatively loosely, and external valved duct means connected the auxiliary liquid compartment in said second slurry section with said auxiliary liquid section at a locus adjacent said second slurry section.

4. A multiple cylinder pumping system comprising a plurality of interconnected pumps as defined in claim 3.

* * * * *